United States Patent [19]

Towsley

[11] 4,053,371

[45] Oct. 11, 1977

[54] CELLULAR METAL BY ELECTROLYSIS

[75] Inventor: Frank E. Towsley, Midland, Mich.

[73] Assignee: The Dow Chemical Company, Midland, Mich.

[21] Appl. No.: 691,692

[22] Filed: June 1, 1976

[51] Int. Cl.[2] ..... C25D 1/08; C25D 7/04; C25D 5/54

[52] U.S. Cl. ..... 204/20; 204/11; 204/26

[58] Field of Search ..... 204/24, 11, 25, 26, 204/20, 23, 9

[56] References Cited

U.S. PATENT DOCUMENTS

| | | | |
|---|---|---|---|
| 2,578,167 | 12/1951 | Bjorklund et al. | 204/16 |
| 2,737,541 | 3/1956 | Coolidge | 204/20 |
| 3,061,525 | 10/1962 | Grazen | 204/16 |
| 3,281,996 | 11/1966 | Cuklanz | 204/16 |
| 3,407,125 | 10/1968 | Fehlner | 204/20 |
| 3,549,505 | 12/1970 | Hanusa | 204/11 |
| 3,597,822 | 8/1971 | Fehlner | 29/183.5 |
| 3,694,325 | 9/1972 | Katz et al. | 204/11 |

FOREIGN PATENT DOCUMENTS

| | | |
|---|---|---|
| 1,199,404 | 7/1970 | United Kingdom |

*Primary Examiner*—T. M. Tufariello
*Attorney, Agent, or Firm*—J. M. Kuszaj

[57] ABSTRACT

A cellular metal structure comprising a continuous interconnected network of electrolytically deposited metal defining a plurality of substantially convex cellular compartments therebetween is disclosed. The metal structure is produced by positioning a cellular array of substantially convex and substantially electrically nonconductive particles having a plurality of interstitial spaces therebetween between the anode and cathode of an electrolytic cell. The array is at least partially immersed in an aqueous solution of an electrolyte suitable for the electrolytic deposition of the metal. A direct current potential is applied between the anode and cathode to electrolytically deposit a continuous interconnected network of metal in the interstitial spaces defined between the cellular array of substantially convex particles.

28 Claims, No Drawings

CELLULAR METAL BY ELECTROLYSIS

BACKGROUND OF THE INVENTION

The present invention relates generally to a cellular metal structure and a process for producing it. More in particular the present invention relates to an electrolytically produced cellular metal structure and process.

Electrolytically produced cellular metal structures or metal foams have previously been described. One common method of production involves applying an electrically conductive coating on a noncoductive substrate and subsequently electrolytically depositing metal on the coating. Examples of such processes are illustrated in, for example, U.S. Pat. Nos. 3,694,325; 3,549,505; and Great Britain Pat. No. 1,199,404. A filamentary metal structure and an electrolytic method of making it are disclosed in U.S. Pat. Nos. 3,597,822 and 3,407,125.

It is desired to electrolytically produce a cellular metal strucutre with a plurality of substantially convex cellular compartments in a minimum number of steps without rendering the surfaces of the cellular substrates electrically conductive.

SUMMARY OF THE INVENTION

The present invention is a cellular metal structure and a process for producing it. The cellular metal structure comprises a continuous interconnected network of electrolytically deposited metal defining a plurality of substantially convex cellular compartments therebetween. The cellular metal structure is such that the deposited metal interfaces the cellular compartments within the cellular metal structure.

The process for electrolytically producing the cellular metal structure comprises providing in an electrolytic cell a cellular array of substantially convex and substantially electrically nonconductive particles, having a plurality of interstitial spaces therebetween. The array is positioned between the anode and the cathode of the electrolytic cell so that at least a portion of the array is in contact with the cathode. The array is at least partially immersed in an aqueous solution of electrolyte suitable for the electrolytic deposition of the metal. A direct current potential is applied between the anode and cathode to electrolytically deposit a continuous interconnected network of metal in the interstitial spaces defined between the cellular array of particles. The network is deposited progressively starting from the cathode and extending through the array toward the anode.

DESCRIPTION OF THE PREFERRED EMBODIMENT

The cellular metal structure of the present invention preferably comprises a continuous interconnected network of electrolytically deposited metal.

Various metals and alloys which are suitable for electrodeposition may be deposited. For example, such metal and metal alloys include copper, silver, nickel, iron, lead, gold, patinum, zinc, tin, chromium, palladium, rhodium, cadmium, cobalt, indium, mercury, vanadium, titanium, tungsten, thallium, gallium, and alloys of the above-mentioned metals. Copper and silver are the preferred electrolytically deposited metals.

The network of elctrolytically deposited metal defines a plurality of substantially convex cellular compartments therebetween. Such that the electrolytically deposited metal interfaces the cellular compartments within the cellular metal structure. Preferably the electrolytically deposited metal defines a plurality of substantially spherical cellular compartment-therebetween.

The network of electrolytically deposited metal preferably occupies from about 1 to about 50 percent and more preferably from about 3 to about 40 percent by volume of the cellular metal structure.

The convex cellular compartments are preferably filled with a substantially electrically nonconducting medium. More preferably, the medium contains at least one member from the group consisting of organic polymeric particles, and inorganic polymeric particles such as glass particles, clay particles and sand particles. Most preferably, the medium contains substantially spherical organic polymeric beads. The medium can, optionally, be a gas, such as air.

Optionally, the convex cellular compartments can be filled with an electrically conducting medium coated with a substantially electrically insulating material.

The diameter of the convex cellular compartments may vary with the intended use for the finished cellular metal product. However, convex cellular compartments having a diameter of from about 0.10 to about 1,000 microns have been found to give satisfactory cellular metal structures. A cellular metal structure wherein the convex cellular compartments have a diameter of from about 0.50 to about 300 microns is preferred.

The network of electrolytically deposited metal preferably defines a plurality of substantially convex cellular compartments arranged in an open cellular array, a closed cellular array or in combinations of open and closed cellular arrays. As used in this context, a closed cellular array is an array in which adjacent cellular compartments are not in contact, or contact each other only at a single point. Access from inside one compartment to an adjacent compartment is limited or nonexistent in a closed array. An open cellular array is an array in which adjacent cellular compartments have a considerable area of mutual interface. There is relatively free access from one compartment interior to another.

The convex cellular compartments are additionally arranged in a random close packed array, a random loose packed array, a random packed array intermediate in density between the random close packed and random loose packed arrays, or in the case of substantially spherical cellular compartments a regular close packed array. Random packing of an array to achieve maximum density is defined to be random close packing, while random packing to achieve minimum density is defined to be random loose packing. Hexagonal or face-centered cubic packing of an array is defined to be regular close packing.

A preferred process for electrolytically producing the cellular metal structure comprises providing in an electrolytic cell a cellular array of substantially convex and substantially electrically nonconductive particles having a plurality of interstitial spaces therebetween. More preferably the particles are selected from the group consisting of organic polymeric beads, and inorganic polymeric beads such as glass beads, clay particles, sand particles and the like. Most preferably the particles are substantially spherical organic polymeric beads, such as polystyrene beads.

The individual particles of the array may be arranged in a closed cellular array, an open cellular array, or in a combination of open and closed cellular arrays. Suitable methods for providing open cellular arrays include applying pressure, heat, or suitable solvents to a closed cellular array to convert point contacts between particles to surface interfaces.

The array is positioned between the anode and the cathode of a suitable electrolytic cell so that at least a portion of the array is in contact with the cathode surface during electrodeposition.

The anode and cathode materials employed are those generally known in the art to be useful as electrodes, for example, graphite, Ru, Rh, Pd, Ag, Os, Cu, Ir, Pt, Au, Ti, Al, W, Ta, Fe and the like. Optionally, the metal to be deposited may serve as the anode or the cathode.

The anode and cathode can be arranged in the electrolytic cell in a variety of geometrics well-known in the art. For example, in one embodiment, the cathode is a flat planar sheet forming the bottom portion of a substantially cylindrical container, the side walls of which are insulating material, and the interior of which is packed with the cellular array. The anode is a flat spiral of wire adapted to fit within the cylindrical container near its top portion.

In another embodiment, the anode and cathode form a circular type cell. In this geometry, the cathode is a central post surrounded by a cellular array held in a porous cylindrical container. Wire wound about the walls of the container forms the anode.

In addition to flat, planar cathodes and central post cathodes, any electrolytic cell geometry that allows the cellular array to be held in close intimate contact with the cathode surface during electrodeposition can be suitably used in the present process.

The array is at least partially, and preferably completely, immersed in an aqueous solution of an electrolyte suitable for the electrolytic deposition of the metal to be deposited. Suitable electrolytes are well-known in the art for each electroplatable metal. For example, where the electroplatable metal is copper, an aqueous acid copper sulfate electrolyte can be used. If silver is to be electroplated, an aqueous basic silver cyanide electrolyte bath is suitable.

Preferably, prior to the introduction of the electrolyte the array of particles is contacted sequentially with sufficient amounts of a low surface tension wetting agent, such as methanol, at subatmospheric pressure and then sufficient amounts of water to remove occluded gases from the array. Pressures of from about 0.1 to 0.2 atmosphere have been found satisfactory for the methanol treatment.

Electrodeposition of the metal is achieved by the application of a direct current potential between the anode and cathode of the electrolytic cell containing the cellular array. Since the array of particles is packed densely into the electrolyte space between electrodes, the applied current flows to deposit metal at the cathode/electrolyte interface. The deposition, however, is confined to the interstitial space between the particles of the array of particles. As a result, a continuous interconnected network of metal is deposited starting at the cathode surface bordering the array. The electrolyte/electrode interface or "front" advances progressively through the array toward the anode.

Following electrodeposition, at least a portion of the array of particles may optionally be removed from the metal network by subjecting an open cellular portion of the array to solvent extraction, pyrolysis, or other suitable techniques for removing the particles without removing the metal network.

Preferably, the surfaces of the substantially electrically nonconductive particles in the array have an electrical conductivity lower than the electrical conductivity of the electrolyte. More preferably, the particles in the array are electrically insulated particles.

The electrodeposition of the present process is preferably carried out at a temperature of from about 0° to about 95° C. More preferably, the electrodeposition is carried out from about 15° to about 35° C at about atmospheric pressure.

Preferably, sufficient potential is applied between the anode and cathode to produce a current denisty of from about 0.10 to about 20 amperes per square foot of cathode surface area. More preferably, sufficient potential is applied to produce a current density of from about 0.10 to about 10 amperes per square foot of cathode surface area.

The cellular metal product produced by the present process may be employed as filtration membranes for gases and liquids, electrode assemblies for batteries and other electrochemical cells, lightweight structural members, impact energy absorbers, abrasive grinding combinations, etc. The cellular metal product can be formed with the appropriate shape and compartment size to fit each of these use areas.

The following examples are illustrative of the process of the present invention.

EXAMPLE 1

A circular type electrolytic cell containing a centrally located cathode rod surrounded by packed beads and the anode, in a circular or cylindrical symmetric arrangement, was employed to produce a cellular copper structure in accordance with the present invention.

The electrolytic cell assembly contained a cathode rod one-fourth inch in diameter and 6 inches in length. The cathode rod was 99.49 percent by weight copper, 0.50 percent by weight tellurium, and contained a trace amount of phosphorus. The cathode rod was cleaned to remove oxide coating with abrasive paper to a uniform bright color level and then stirred in $CH_3CCl_3$ solvent. The rod was subsequently immersed and stirred in a solution of 250 ml 0.1 normal (N) NaOH mixed with 1.25 grams (g) $Na_2CO_3$ for 20 to 30 minutes.

The cathode was inserted in the center of a cylindrical Alundum® round bottom thimble with an outside diameter of 26 millimeters (mm) and an outside height of 60 mm. The thimble material contained sintered aluminum oxide particles and formed a porous, electrically insulated and mechanically strong container. The pores of the thimble were of a size no greater than that sufficient to contain about −45 mesh (U.S. Standard) polystyrene beads, but were large enough to permit flow of electrolyte between an electrolyte reservoir and the interior of the thimble.

A helical coil, hand-wound from one-eighth inch outside diameter copper tubing, was placed around the outside wall of the thimble to form the anode. The central hole in the copper tubing was about one-tenth of the tube diameter, and the winding mandrel was a 1 5/16 inch diameter steel pipe. The copper tubing was cleaned with abrasive paper before winding, and treated with $CH_3CCL_3$ solvent and $NaOH/NaCO_3$ in substantially the same manner as the cathode.

Silicone rubber gaskets one-eighth inch in thickness, were adapted to fit around the cathode rod near the top and bottom ends of the rod. The washers were of sufficient diameter to fit in the barrel of the thimble and form a tight fit, especially at the bottom end of the cathode. The clearance between the uper washer and the lower washer was about 1⅜ inch.

The interior of the thimble was packed with substantially spherical beads. The beads were polystyrene with 4.0% divinylbenzene and traces of isopentane. The beads passed through a U.S. Standard No. 45 sieve, but were caught on a U.S. Standard No. 50 sieve. The average size of the bead was about 330 microns. The beads were stirred with deionized water in a small beaker and then poured into the thimble with the cathode rod and the lower washer inserted in place. The beads were manually pressed down from above to pack the beads in the thimble space.

When sufficient beads were added to fill the thimble to about one third inch from the top, the upper washer was added to the thimble.

The electrolyte contained 900 milliliter (ml) deionized water, 135.5 g of $CuSO_4.5H_2O$, 60 ml concentrated $H_2SO_4$ (density 1.84 grams per cubic centimeter (g/cc)) and 110 mg gelatin powder. The electrolyte was placed in the interior of the thimble and in the electrolyte reservoir.

The electrolytic cell circuitry contained a direct current power source, a 50 ohm resistor and a 0–20 ohm variable resistor connected in series between the power source and a 0–300 milliampere meter. A high impedance multirange voltmeter was connected between the cathode rod and the anode.

The cell was allowed to equilibrate for 1.5 hours, and then a direct current potential of 0.100 volts was applied across the cell and the current was adjusted to about 50 milliamperes. This level corresponded to about 4.8 amperes per square foot current density at the cathode rod surface. Copper metal was deposited at the cathode rod surface and the plating interface advanced through the packed beads toward the walls of the thimble.

When copper metal had substantially filled the available interstitial spaces between the beads within a three eighth inch radius of the cathode rod, the cell was disconnected and the cellular copper structure was removed.

The product was a cellular copper structure comprising a continuous network of electrolytically deposited copper defining a plurality of substantially spherical compartments containing polystyrene therebetween. The cathode rod may be removed from the cellular metal by suitable means well-known in the art. The lightweight cellular metal product formed is of sufficient strength to withstand aluminum machining speeds without cracking.

EXAMPLE 2

An electrolytic cell with a geometry resembling a hollow cylinder was employed to produce a cellular silver structure in accordance with the present invention.

The cell contained a 2 inch diameter disk-shaped hole in a thick (one eighth inch) silastic rubber sheet. A flat silver sheet bordered the cell region at the bottom and served as the cathode. The sheet was 4 inches square and 0.005 inch thick. It was cleaned substantially as described for the cathode in Example 1.

The silastic rubber sheet containing the disk-shaped hole was bordered on the top by a perforated polypropylene disk one eighth inch thick. A 2 inch diameter glass tube for containing the electrolyte was placed over the perforated disk. The glass tubing was 1 1/2 inch in height and about 0.2 inch thick.

Spherical polystyrene beads with diameters in the 10 to 20 micron range were sintered together by compression molding at about 95° C to form a bead sinter that resembled a disk. The bead sinter had about 30 percent by volume void space.

The sintered beads were then placed in the disk shaped hole in the silastic rubber sheet. The glass walled tube section was placed atop the silastic rubber sheet, enclosing the cell content.

After cell assembly, 70 ml of methanol were introduced into the cell to fill the glass tube reservoir and immerse the sintered beads. The pressure around the assembly was reduced to about 0.1 atmosphere. After about 10 minutes the methanol was drained and replaced with 70 ml of deionized water. After 2 hours the water was drained from the reservoir and replaced with electrolyte. Loading in this way eliminated gas bubbles between beads, while allowing cell filling with relatively high surface tension electrolyte.

Liquid electrolyte was introduced into the glass tube. The electrolyte contained 90 g/l silver cyanide, 112.5 g/l potassium cyanide, 15 g/l potassium carbonate, 15 g.l potassium hydroxide, 0.04 cc/l of 60% solution of ammonium thiosulfate, and 1000 ml deionized water.

A silver wire helically wound circular anode with a one eighth inch outside helix diameter was introduced into the electrolyte at the top region of the glass tube container.

The cell circuitry was substantially as described in Example 1.

The cell was operated at a voltage starting at 0.062 volts and ending at 0.142 volts. The amperes per square foot of cathode surface area was maintained at 0.55. A cellular silver structure with sintered spherical beads of polystyrene surrounded by electrolytically deposited silver was produced.

After the cellular silver structure was removed from the cell, the structure was stirred for 2 hours in toluene to dissolve the polystyrene. The final product was a 1 inch diameter by 8 mils thick disk-shaped porous silver structure with 29.8 percent solid silver and 70.2 percent voids.

The product was useful as an oxygen diffusion electrode in a cell with alkaline electrolyte.

What is claimed is:

1. A cellular metal structure comprising a continuous interconnected network of electrolytically deposited metal defining therebetween a plurality of substantially convex and substantially electrically nonconductive cellular compartments arranged in both closed and open cellular arrays such that the deposited metal interfaces the cellular compartments within the cellular metal structure.

2. The cellular metal structure of claim 1 wherein the electrolytically deposited metal is selected from the group consisting of copper, silver, palladium, platinum, nickel, iron, lead, gold, zinc and tin.

3. The cellular metal of claim 1 wherein the electrolytically deposited metal is silver.

4. The cellular metal of claim 1 wherein the electrolytically deposited metal is copper.

5. The cellular metal structure of claim 1 wherein the electrolytically deposited metal defines a plurality of substantially convex cellular compartments arranged in an open cellular array.

6. The cellular metal structure of claim 1 wherein the convex cellular compartments are filled with a substantially electrically nonconducting medium.

7. The cellular metal structure of claim 6 wherein the medium is a gas.

8. The cellular metal structure of claim 7 wherein the gas is air.

9. The cellular metal structure of claim 6 wherein the medium comprises at least one member selected from the group consisting of organic polymeric particles and inorganic polymeric particles.

10. The cellular metal structure of claim 6 wherein the medium comprises substantially spherical organic polymeric beads.

11. The cellular metal structure of claim 1 wherein the convex cellular compartments are filled with an electrically conducting medium coated with a substantially electrically insulating material.

12. The cellular metal structure of claim 1 wherein the electrolytically deposited metal occupies from about 1 to about 50 percent by volume of the cellular metal structure.

13. The cellular metal structure of claim 1 wherein the electrolytically deposited metal occupies from about 3 to about 40 percent by volume of the cellular metal structure.

14. The cellular metal structure of claim 1 wherein the convex cellular compartments have a diameter of from about 0.1 to about 1000 microns.

15. The cellular metal structure of claim 1 wherein the convex cellular compartments have diameter of from about 0.50 to about 300 microns.

16. The cellular metal structure of claim 1 wherein the electrolytically deposited metal defines a plurality of substantially convex cellular compartments arranged in a random close packed array.

17. The cellular metal structure of claim 1 wherein the electrolytically deposited metal defines a plurality of substantially convex cellular compartments arranged in a random loose packed array.

18. The cellular metal structure of claim 1 wherein the electrolytically deposited metal defines a plurality of substantially convex cellular compartments arranged in a random packed array intermediate in density between a random close packed array and a random loose packed array.

19. The cellular metal structure of claim 1 wherein the electrolytically deposited metal defines a plurality of substantially spherical cellular compartments therebetween.

20. The cellular metal structure of claim 19 wherein the electrolytically deposited metal defines a plurality of substantially spherical cellular compartments arranged substantially in a regular close packed array.

21. A process for electrolytically producing a cellular metal structure comprising:

a. providing in an electrolytic cell a cellular array of substantially convex and substantially electrically nonconductive particles having a plurality of interstitial spaces therebetween;

b. positioning the array between the anode and the cathode of the electrolytic cell so that at least a portion of the array is in contact with the cathode;

c. at least partially immersing the array in an aqueous solution of an electrolyte suitable for the electrolytic deposition of the metal;

d. applying a direct current potential between the anode and cathode to electrolytically deposit a continuous interconnected network of metal in the interstitial spaces defined between the nonconductive cellular array of particles, the network being deposited progressively starting from the cathode and extending through the array toward the anode.

22. The process of claim 21 including the additional step of contacting the array between steps (b) and (c) sequentially with methanol at subatmospheric pressure and then water to remove occluded gases from the array.

23. The process of claim 21 wherein electrodeposition is carried out at a temperature of from about 0° to about 95° C.

24. The process of claim 21 wherein electrodeposition is carried out at a temperature of from about 15° to about 35° C.

25. The process of claim 24 wherein the electrodeposition is carried out at atmospheric pressure.

26. The process of claim 21 wherein sufficient potential is applied between the anode and cathode to produce a current density of from about 0.10 to about 20 amperes per square foot of the cathode surface.

27. The process of claim 21 wherein sufficient potential is applied between the anode and cathode to produce a current density of from about 0.10 to about 10 amperes per square foot of the cathode surface.

28. The process of claim 21 wherein the surfaces of the substantially electrically nonconductive particles have an electrical conductivity less than the electrical conductivity of the electrolyte.

* * * * *